US009538895B1

(12) United States Patent
Shippen et al.

(10) Patent No.: US 9,538,895 B1
(45) **Date of Patent: *Jan. 10, 2017**

(54) WHISK BROOM WITH SQUEEGEE

(71) Applicant: NELI, LLC, Orem, UT (US)

(72) Inventors: Ben R. Shippen, Orem, UT (US); Stephen R. Shippen, Orem, UT (US); Scott M. Shippen, Orem, UT (US); David S. Shippen, Orem, UT (US)

(73) Assignee: Neli LLC, Orem, UT (US)

( * ) Notice: Subject to any disclaimer, the term of this patent is extended or adjusted under 35 U.S.C. 154(b) by 440 days.

This patent is subject to a terminal disclaimer.

(21) Appl. No.: 14/149,429

(22) Filed: Jan. 7, 2014

Related U.S. Application Data

(60) Provisional application No. 61/750,264, filed on Jan. 8, 2013.

(51) Int. Cl.
*A47L 13/52* (2006.01)
*A47L 13/12* (2006.01)

(52) U.S. Cl.
CPC ..... *A47L 13/12* (2013.01); *A47L 13/52* (2013.01)

(58) Field of Classification Search
CPC ..... A47L 1/06; A47L 13/11; A47L 13/12; A46B 15/0055
See application file for complete search history.

(56) References Cited

U.S. PATENT DOCUMENTS 898,316 A * 9/1908 Carlson ..... A47L 13/24 15/117
5,207,755 A * 5/1993 Ampian ..... A46B 5/0075 15/144.1
8,904,589 B2 * 12/2014 Santarsiero ..... A47L 13/11 15/105
2002/0184728 A1 12/2002 Kortleven
2003/0051301 A1 * 3/2003 Morgan ..... A47L 5/30 15/49.1
2007/0234497 A1 * 10/2007 Lee ..... A47L 13/12 15/144.1
2008/0072388 A1 * 3/2008 Jones ..... A46B 5/0075 15/105
2011/0302735 A1 12/2011 Santarsiero et al.

OTHER PUBLICATIONS

U.S. Appl. No. 14/955,854, filed Dec. 1, 2015, Shippen et al.
U.S. Appl. No. 29/549,310, filed Dec. 21, 2015, Shippen et al.
Cleaningquickie. "Spill Collector Accessed by Quickie Manufacturing." YouTube, Jul. 30, 2013. Web. Accessed Dec. 17, 2014. https://www.youtube.com/watch?v=NJakCDTdW9U.

* cited by examiner

*Primary Examiner* — Shay Karls
(74) *Attorney, Agent, or Firm* — Workman Nydegger

(57) ABSTRACT

A device having the ability to alternate between dry spill and wet spill clean-up by simply rotating the head of the device to either the bristle side, for dry material clean-up, or the rubber squeegee side for wet material clean-up. Located on the handle is a release button coupled to the rotatable coupling by which the head rotates about the handle. When this button is pulled or otherwise selectively activated (e.g., pushed, pressed, etc.) the head will now rotate freely allowing the user to alternate between dry and wet clean-up. In an embodiment, the head may be locked at a variety of angles for side sweeping applications such as inside a cabinet, on top of a work bench, etc.

20 Claims, 18 Drawing Sheets

WHISK BROOM WITH SQUEEGEE

CROSS-REFERENCE TO RELATED APPLICATIONS

The present application claims the benefit of U.S. Patent Application Ser. No. 61/750,264, filed Jan. 8, 2013, entitled "WHISK BROOM WITH SQUEEGEE", the disclosure of which is incorporated by reference in its entirety.

BACKGROUND OF THE INVENTION

1. The Field of the Invention

This invention relates to whisk brooms, squeegees, and related systems.

2. Background and Relevant Art

Whisk brooms and dustpans are common items found in most business and home settings. Whisk brooms and dustpans come in a variety of shapes and sizes. They are used to clean up a variety of dry spill debris only. Often, there is a need to clean up a wet spill, or a spill including both wet and dry components. Existing whisk brooms have limited usefulness in such circumstances.

BRIEF SUMMARY

The present invention provides a product having the ability to alternate between dry spill and wet spill clean-up by simply rotating the head to either the bristle side, for dry material clean-up, or the rubber squeegee side for wet material clean-up. Once rotated to the rubber squeegee side the user may now clean-up wet spills such as paint, oil, milk, a dropped egg, etc. Located on the handle is a release button. When this button is pulled or otherwise selectively activated (e.g., pushed, pressed, etc.) the head containing bristles on one end and a squeegee on the other will now rotate freely allowing the user to alternate between dry and wet clean-up. The whisk broom is used in identical fashion as existing whisk brooms, e.g., by simply sweeping the debris into the dustpan, then emptying the dustpan into the garbage. To use the squeegee to clean-up a wet spill the user rotates the head to the squeegee side, then presses the squeegee to the floor in front of the wet spill and moves (e.g., pulls) the spill into the dustpan. The liquid materials can simply be dumped and rinsed from the dustpan in a sink or basin to empty the dustpan. The squeegee edge of the broom head may be cleaned in similar fashion. The head may be locked at a variety of angles for side sweeping applications such as inside a cabinet or on top of a work bench, etc.

For example, according to an embodiment, a combination whisk broom and squeegee device may comprise an elongate handle, a rotatable head that is rotatably attached to the handle, and a release button disposed on or within the handle. The head includes a whisk broom end with a plurality of whisk broom bristles at one end of the head. The opposite squeegee end of the head includes a squeegee (e.g., a rubber or elastomeric tapered squeegee blade overmolded over the opposite end). The whisk broom end may be used to sweep up dry spills, while the squeegee end may be used to clean up wet spills. The head is rotatably coupled (e.g., snap-fitted) to the handle, so that the head is selectively rotatable and selectively lockable in a desired orientation relative to the handle so as to orient the whisk broom end or the squeegee end in a desired locked orientation for use of a respective end. The release button may be coupled to the snap fit or other rotatable coupling structure of the head to selectively release and selectively lock the rotatable head in a desired orientation relative to the handle.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Introduction

The present invention provides a product having the ability to alternate between dry spill and wet spill clean-up by simply rotating the head to either the bristle side, for dry material clean-up, or the rubber squeegee side for wet material clean-up. Once rotated to the rubber squeegee side the user may clean-up wet spills such as paint, oil, milk, water, a dropped egg, etc. Located on the handle is a release button coupled to the rotatable coupling by which the head rotates about the handle. When this button is pulled or otherwise selectively activated (e.g., pushed, pressed, etc.) the head containing bristles on one end and a squeegee on the other will now rotate freely allowing the user to alternate between dry and wet clean-up. The whisk broom is used in identical fashion as existing whisk brooms, e.g., by simply sweeping the debris into the dustpan, then emptying the dustpan into the garbage. To use the squeegee to clean-up a wet spill the user rotates the head to the squeegee side, then presses the squeegee to the floor in front of the wet spill and moves (e.g., pulls) the spill into the dustpan. The liquid materials can simply be dumped and rinsed from the dustpan in a sink or basin to empty and clean the dustpan. The squeegee edge of the broom head may be cleaned in similar fashion. In an embodiment, the head may be locked at a variety of angles for side sweeping applications such as inside a cabinet, on top of a work bench, etc.

According to an embodiment, a combination whisk broom and squeegee device may comprise an elongate handle, a rotatable head that is rotatably attached to the handle, and a release button disposed on or within the handle. The head includes a whisk broom end with a plurality of whisk broom bristles at one end of the head. The opposite squeegee end of the head includes a squeegee (e.g., a rubber or elastomeric tapered squeegee blade overmolded over the opposite end). The whisk broom end may be used to sweep up dry spills, while the squeegee end may be used to clean up wet spills. The head is rotatably coupled (e.g., snap-fitted) to the handle, so that the head is selectively rotatable and selectively lockable in a desired orientation relative to the handle so as to orient the whisk broom end or the squeegee end in a desired locked orientation for use of the respective end. The release button may be coupled to the snap fit or other rotatable coupling structure of the head to selectively release and selectively lock the rotatable head in a desired orientation relative to the handle.

III. Exemplary Combination Whisk Broom and Squeegee Devices

Figure 1:
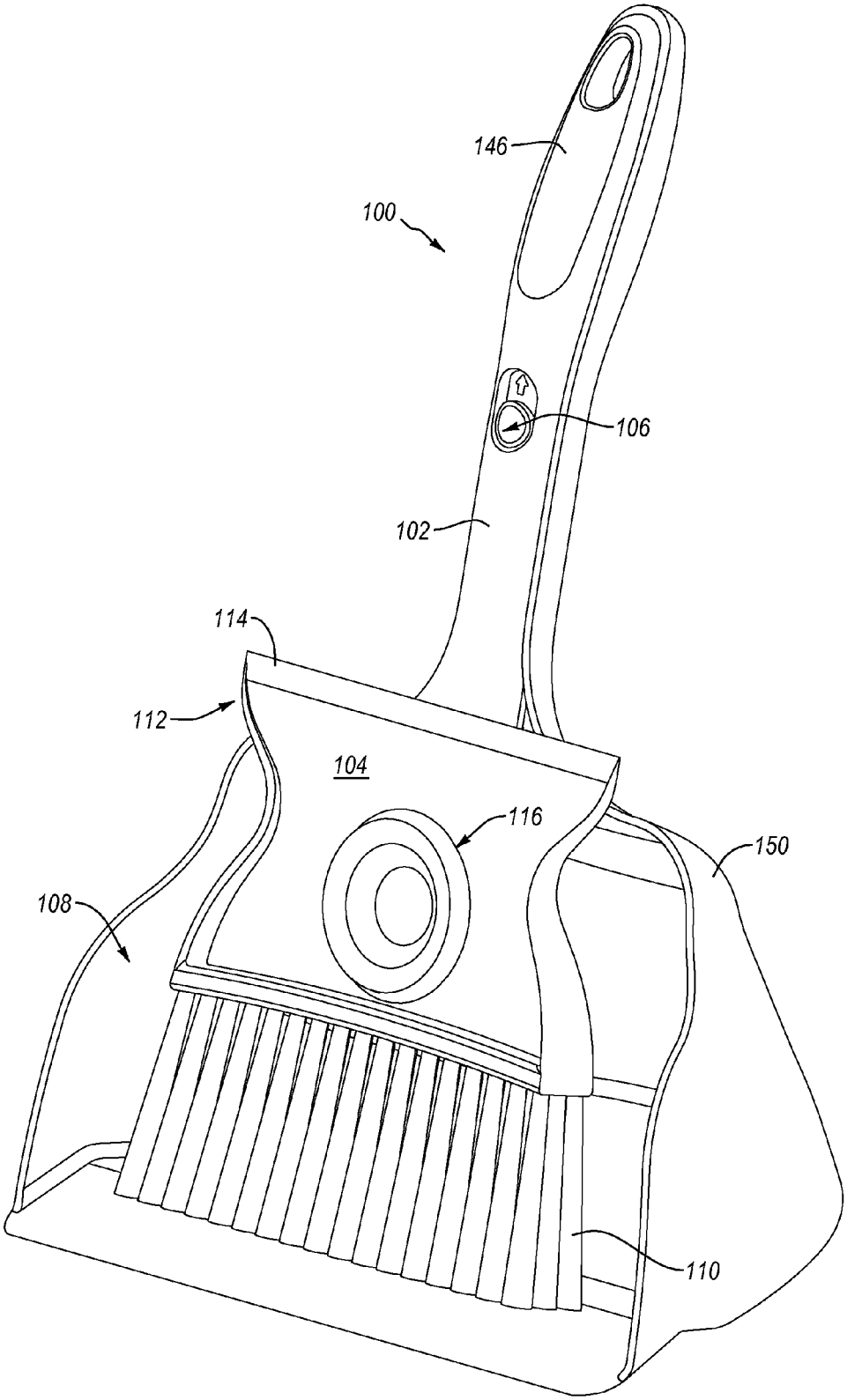
FIG. 1 is an isometric view of an exemplary combination whisk broom with squeegee.

The Figures illustrate an exemplary combination device 100. FIG. 1 shows device 100, in combination with an associated dustpan 150. Combination whisk broom and squeegee device 100 includes an elongate broom or squeegee handle 102, a rotatable head 104, and a release button 106. Head 104 includes a whisk broom end 108, with a plurality of whisk broom bristles 110. Head 104 also includes an opposite squeegee end 112, with a squeegee 114 disposed thereon. Squeegee 114 may comprise a tapered blade of rubber or similar elastomeric material suitable for spreading, pushing, pulling, or wiping liquid from a flat surface. Squeegee 114 may be overmolded over edge 112, or may be secured by any suitable mechanism (e.g., mechanical retention mechanism, adhesive, etc.). Whisk broom bristles 110 may similarly be secured into end 108 by any suitable mechanism (e.g., press fit, secured with adhesive, etc.).

Head 104 is rotatably coupled to handle 102, e.g., at snap fit rotatable coupling 116. Head 104 is selectively rotatable about coupling 116, allowing head 104 to be locked into one of any number of given positions. This allows a user to orient head 104 relative to handle 102 in a desired configuration to employ either the whisk broom end (i.e., bristles 110) or the squeegee end (i.e., squeegee 114) of head 104, as desired.

Figure 2:
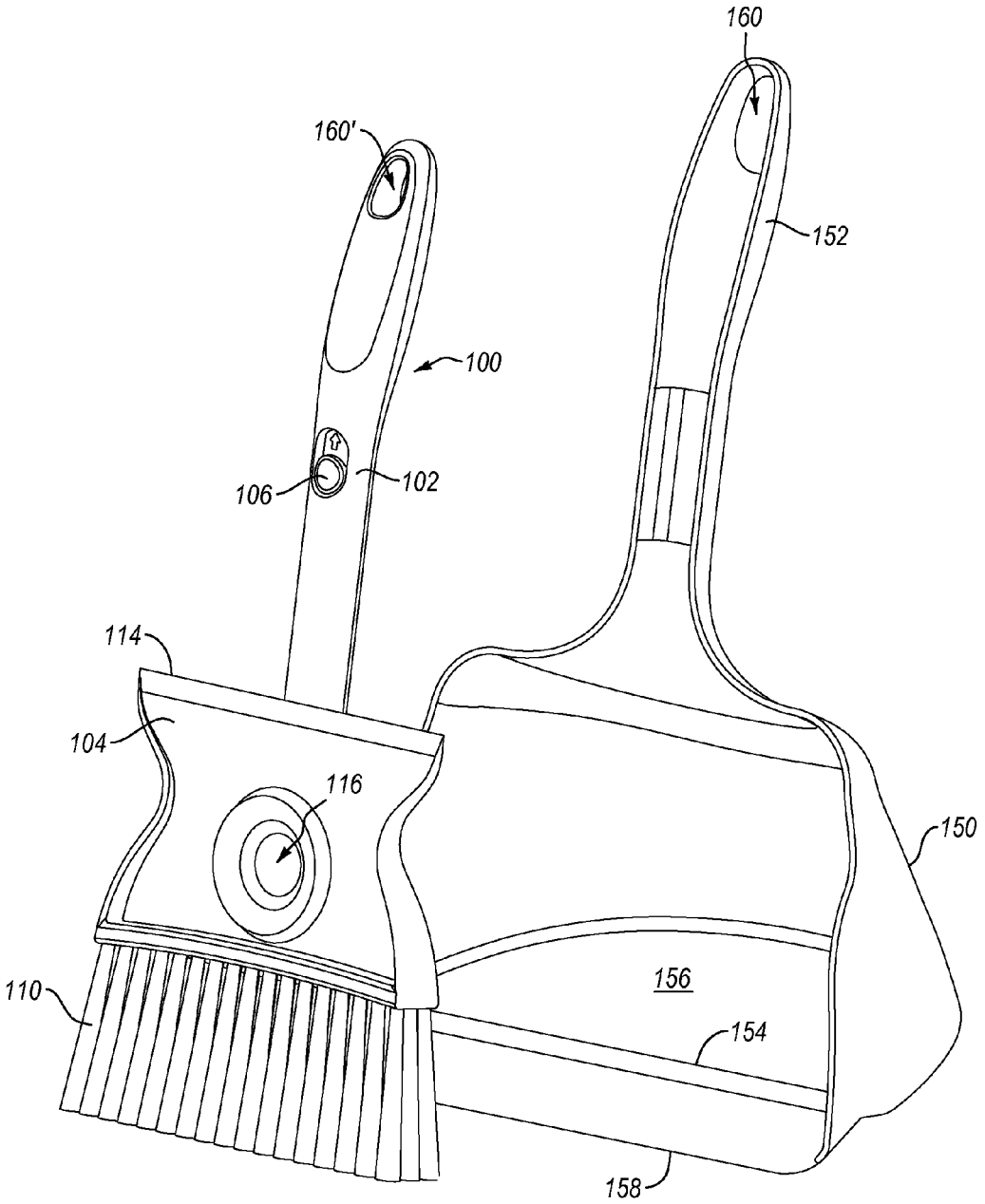
FIG. 2 shows the combination broom with the head rotated in an orientation to sweep dry, solid waste or debris into the associated dustpan.

Release button 106 works with the rotatable coupling 116 to allow selective release of coupling 116, allowing head 104 to rotate freely, followed by relocking head 104 into a desired orientation upon release of button 106, following rotation. FIGS. 1 and 2 show head 104 in an orientation where device 100 is prepared for use as a whisk broom. As shown in FIG. 2, with device 100 separated from dustpan 150, dry debris and other dry waste may be swept into dustpan 150. Dustpan 150 may include an elongate dustpan handle 152 which is hollow and concave along its longitudinal axis (e.g., with a generally U-shaped transverse cross-section), so as to be configured to matingly receive the front or rear surface of handle 102. In other words, hollow handle 152 is correspondingly shaped and sized so as to receive and retain handle 102 of device 100 when handle 102 is pressed into dustpan handle 152, as shown in FIG. 1.

As seen in FIG. 2, dustpan 152 may include an integrated retention dam 154 in bottom surface 156 of dustpan 150, to help retain debris therein. Leading edge 158 of dustpan 150 may further include an overmolded or other elastomeric material edge or blade to help seal dustpan 150 to the floor as materials are guided from the floor over edge 158, over retention dam 154, and down into bottom surface 156 of dustpan 150. Dustpan handle 152 and handle 102 may further each include corresponding and aligned eyelet handing holes 160 and 160', respectively for facilitating hanging of the dustpan 150 and combination device 100 in their coupled configuration (FIG. 1) on a hook.

Figure 3:
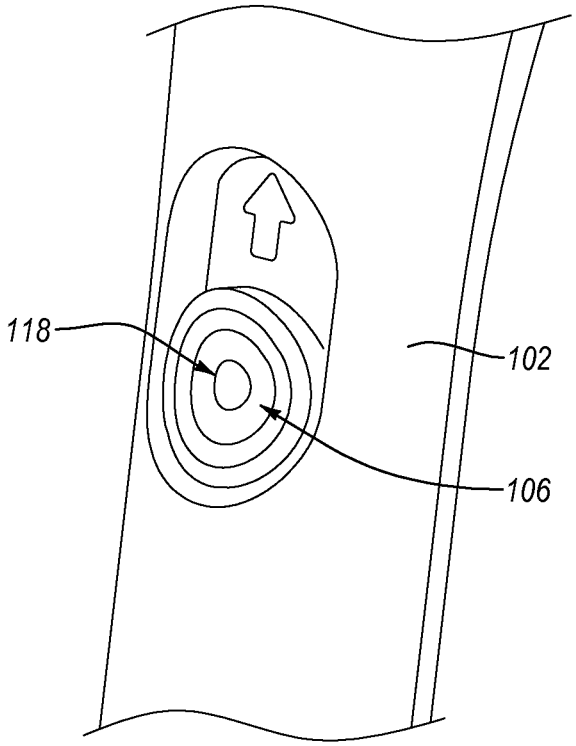
FIG. 3 is a close up view of an exemplary release button on the broom handle.
Figure 4:
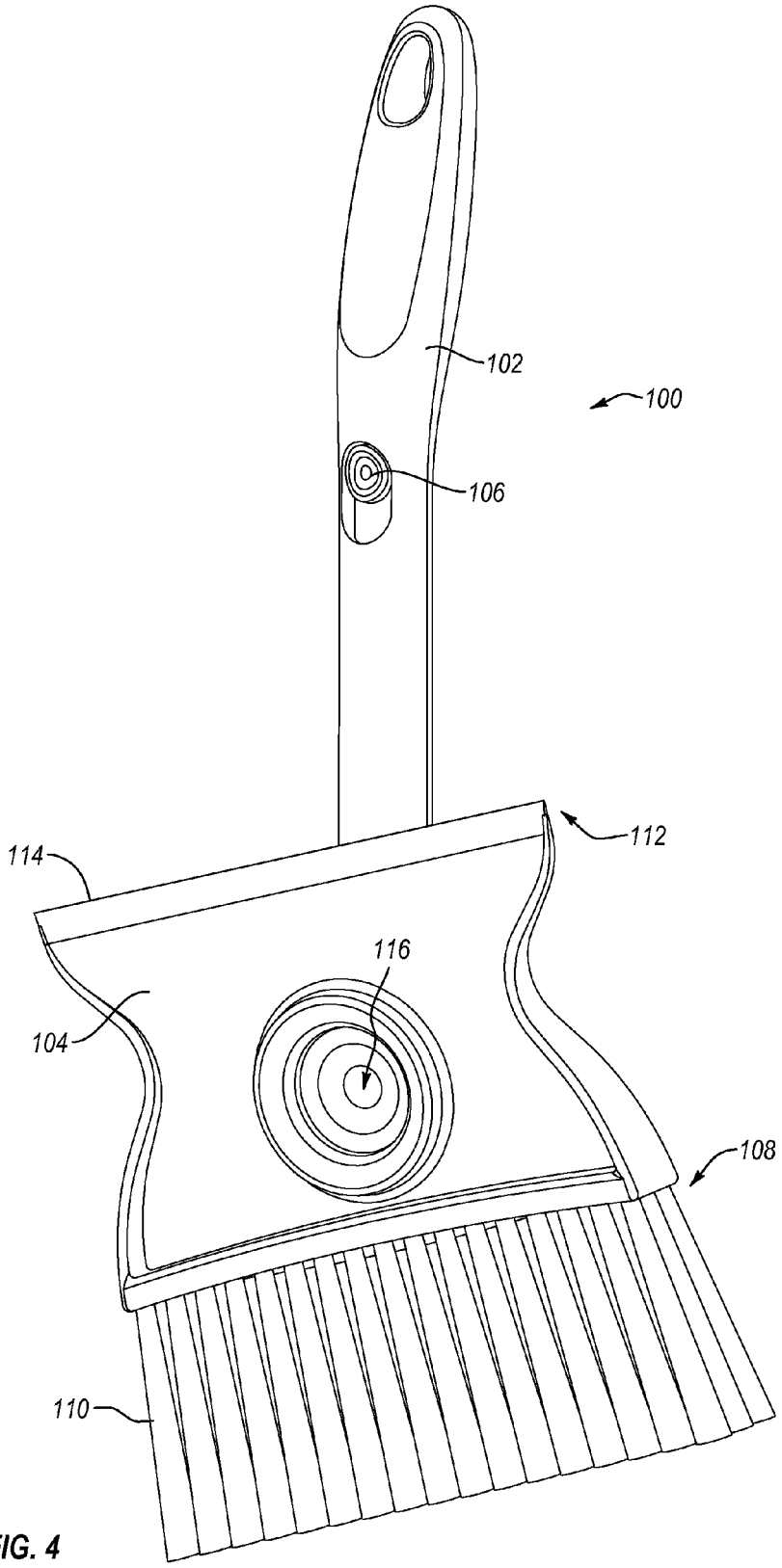
FIG. 4 shows release and rotation of the combination broom and squeegee head.

FIG. 3 shows a close up view of the release button 106. Button 106 may be configured to slide within handle 102. Button 106 may be slidable between a first position (e.g., as seen in FIGS. 1-3) corresponding to a locked configuration, where head 104 is locked against rotation. When release button 106 is slid to a second position (e.g., slid up), as seen in FIG. 4, head 104 is unlocked, and becomes freely rotatable about coupling 116. As seen in FIG. 3, release button 106 may include a finger recess (e.g., a smooth concave curved recess) 118, allowing a user to easily insert a finger and pull button 106 upwards.

Figure 5A:
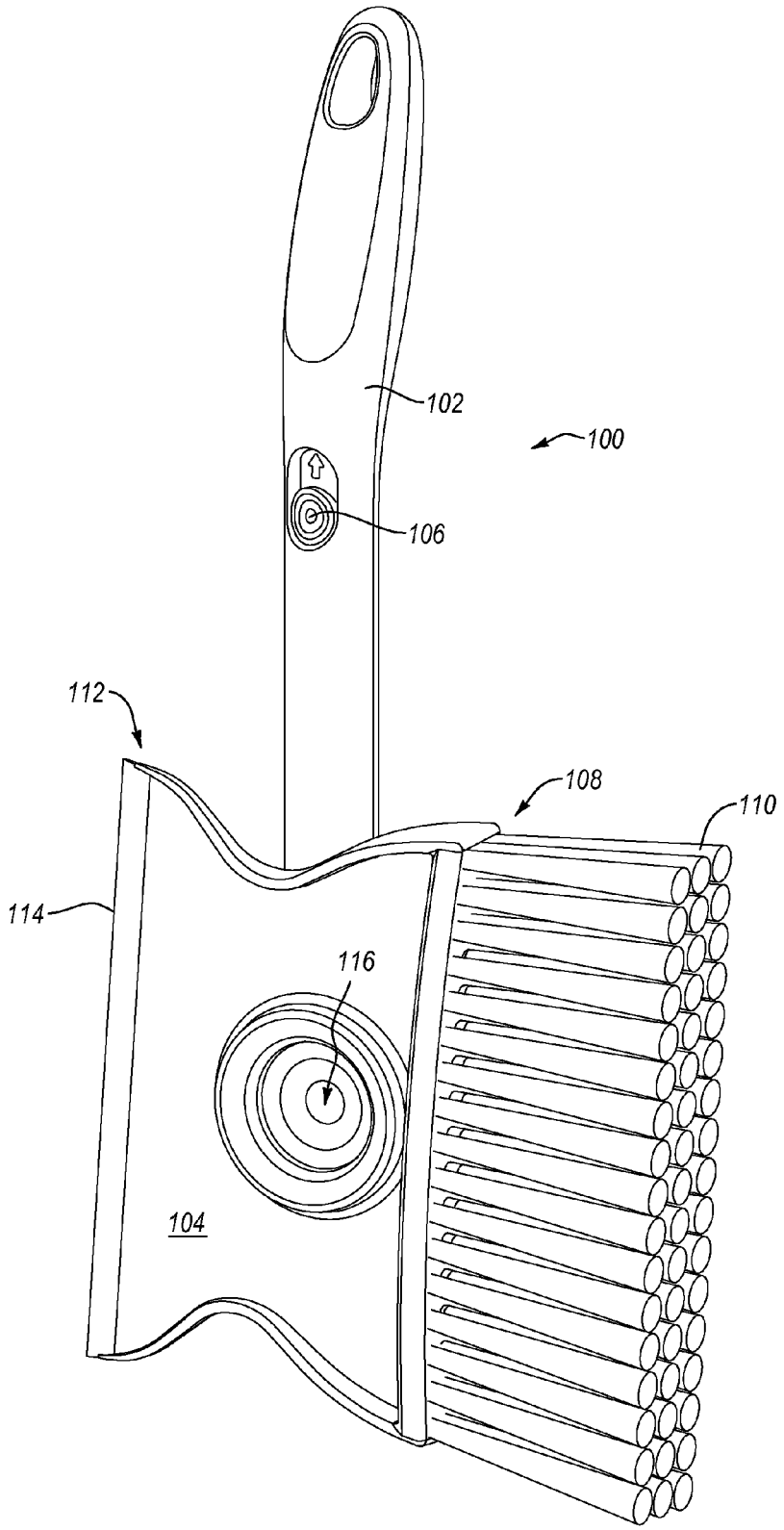
FIG. 5A shows rotation of the broom bristles to a selected angle of 90° relative to the "bristles down" configuration.
Figure 5B:
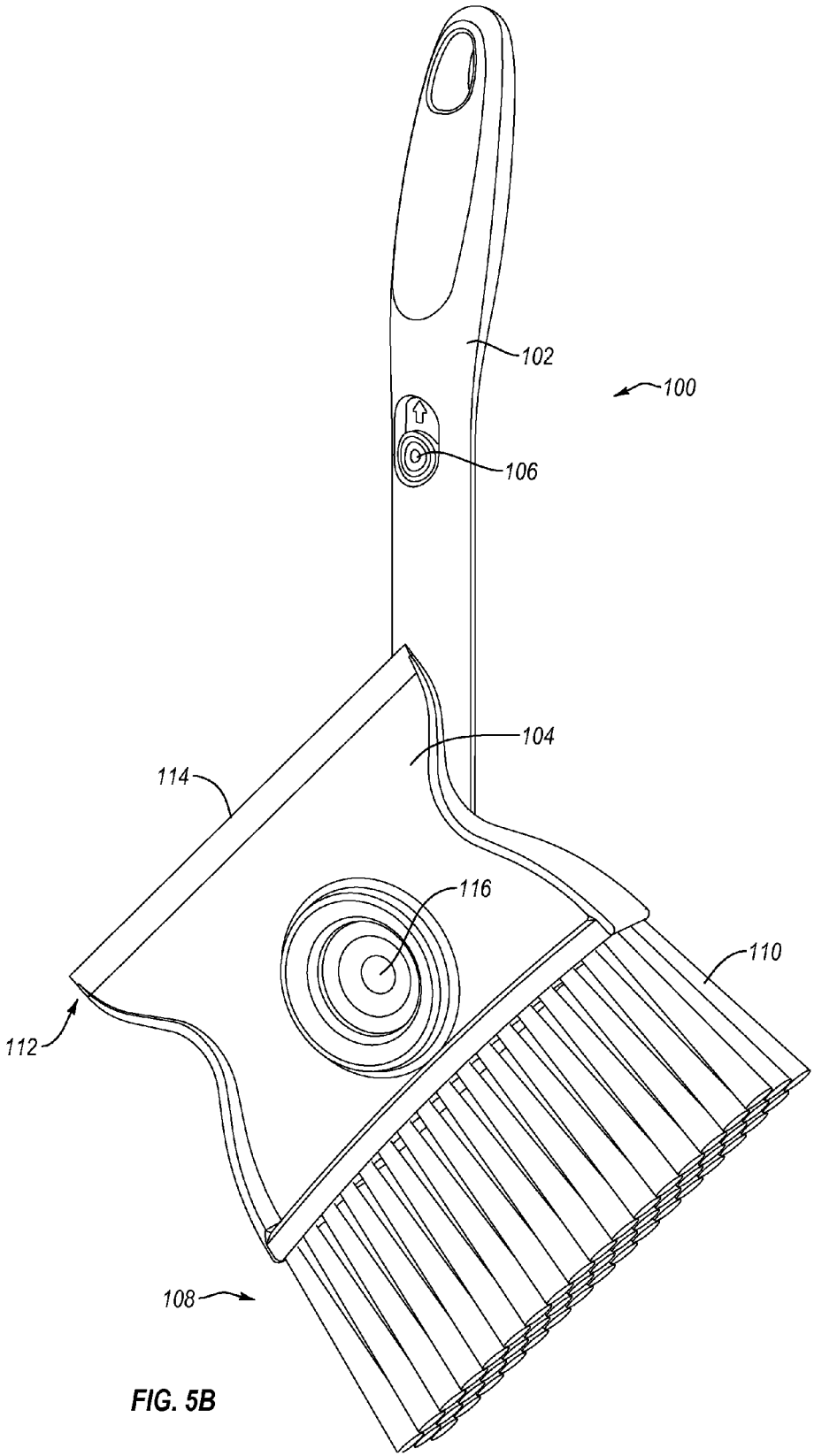
FIG. 5B shows rotation of the broom bristles to a selected angle of 45° relative to the "bristles down" configuration.
Figure 5C:
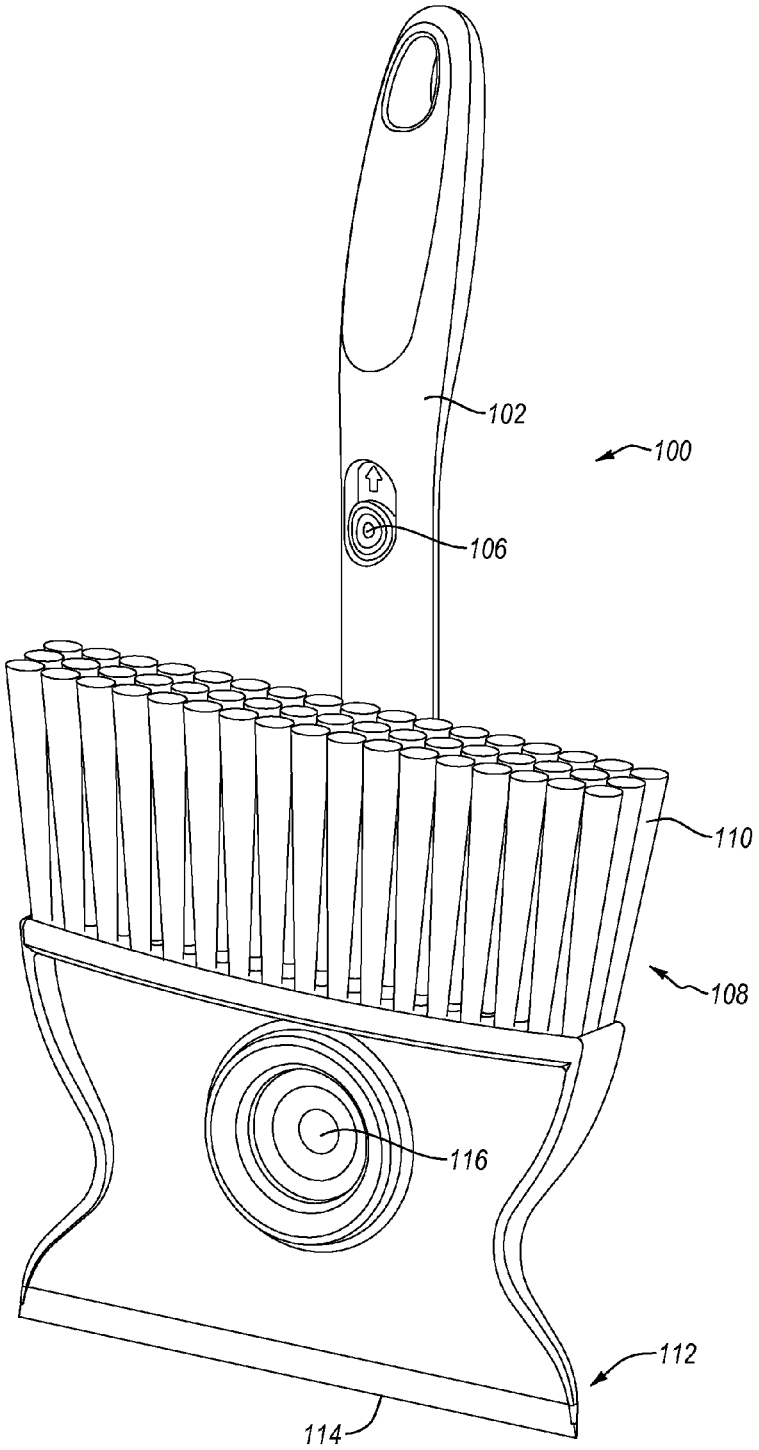
FIG. 5C shows rotation of the broom bristles to a selected angle of 180° relative to the "bristles down" configuration, so that the squeegee end of the head is oriented down.
Figure 6:
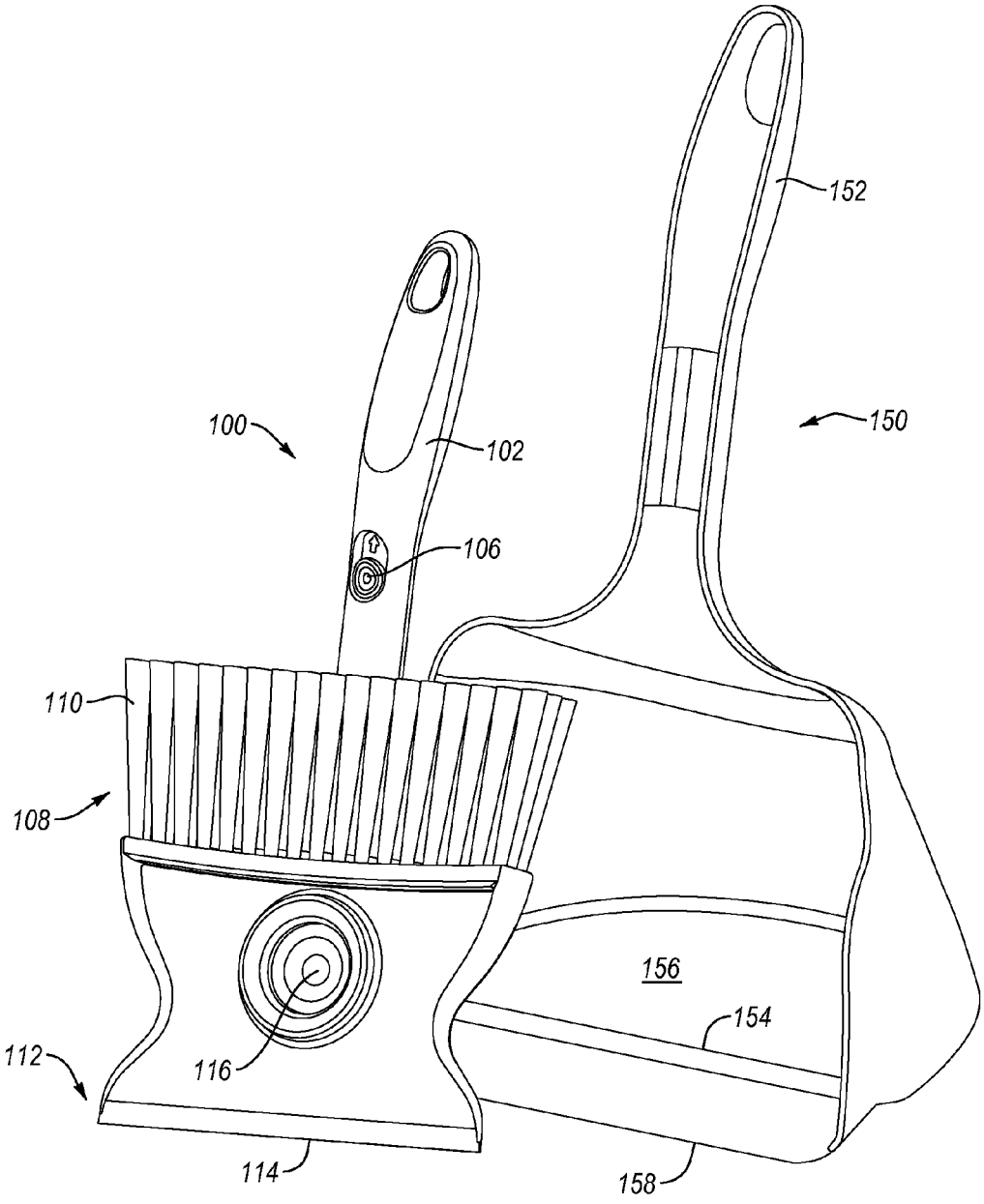
FIG. 6 shows the combination broom with the head rotated to the orientation of FIG. 5C to move liquid or wet waste or debris into the dustpan.

FIGS. 4-6 show release of head 104 and its rotation to various orientations other than the "bristles down" orientation of FIGS. 1-2. For example, in FIG. 4, button 106 is in a released position, allowing free rotation (e.g., 360°) of head 104 about handle 102, through coupling 116. Coupling 116 is shown disposed within a central portion of head 104, rather than disposed near either extreme end 112 or 108. Coupling 116 is also shown generally centered side-to-side within head 104. Although illustrated as such, other configurations may also be possible.

FIG. 5A shows head 104 having been rotated counterclockwise 90°, and then locked in that position (e.g., button 106 is shown in the down, or locked position). Such an orientation may be useful in sweeping a vertical surface (e.g., dusting, removing cobwebs or other debris from a wall, cabinet, or other vertical surface).

FIG. 5B shows head 104 having been rotated counterclockwise only 45°, and locked in that position relative to the position shown in FIG. 1. Such a configuration may be useful in sweeping cobwebs, dust, or other debris from crown molding that forms an angle between a vertical wall and a horizontal ceiling, or similarly oriented surfaces. While only these specific angled locked positions are shown, it will be appreciated that the coupling 116 may be configured to allow rotation of head 104 about handle 102 for a full 360°, and that locking may be provided at any desired positions along such full rotation (e.g., every 90°, every 45°, etc.). Other locking positions will be apparent to those of skill in the art.

FIG. 5C shows rotation of 180° from that shown in FIGS. 1-2, positioning squeegee blade 114 for use in cleaning a liquid spill or other debris from a floor or similar flat surface. FIG. 6 shows this locked orientation, adjacent to dustpan 150, e.g., so as to pull or otherwise move liquids or other wet debris into dustpan 150. Providing a rubber or elastomeric leading edge 108, as well as a retention dam 154 as described above may be particularly beneficial when using squeegee blade 114 to move liquids into dustpan 150. For example, dam 154 may aid in preventing such liquids from flowing out of dustpan 150, as they may otherwise tend to do merely under influence of gravity.

Figure 7:
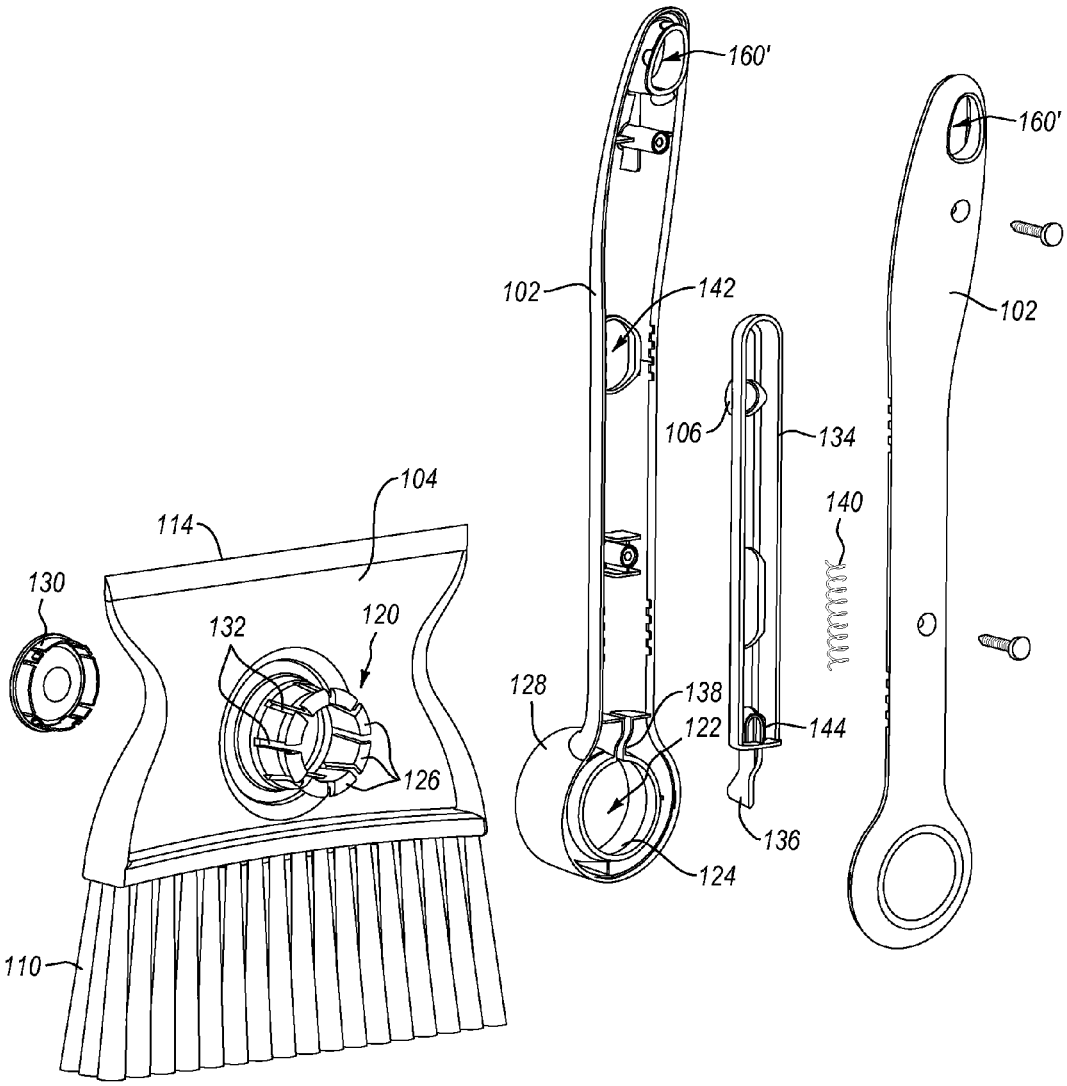
FIG. 7 shows an exploded view of the combination whisk broom and squeegee.
Figure 8A:
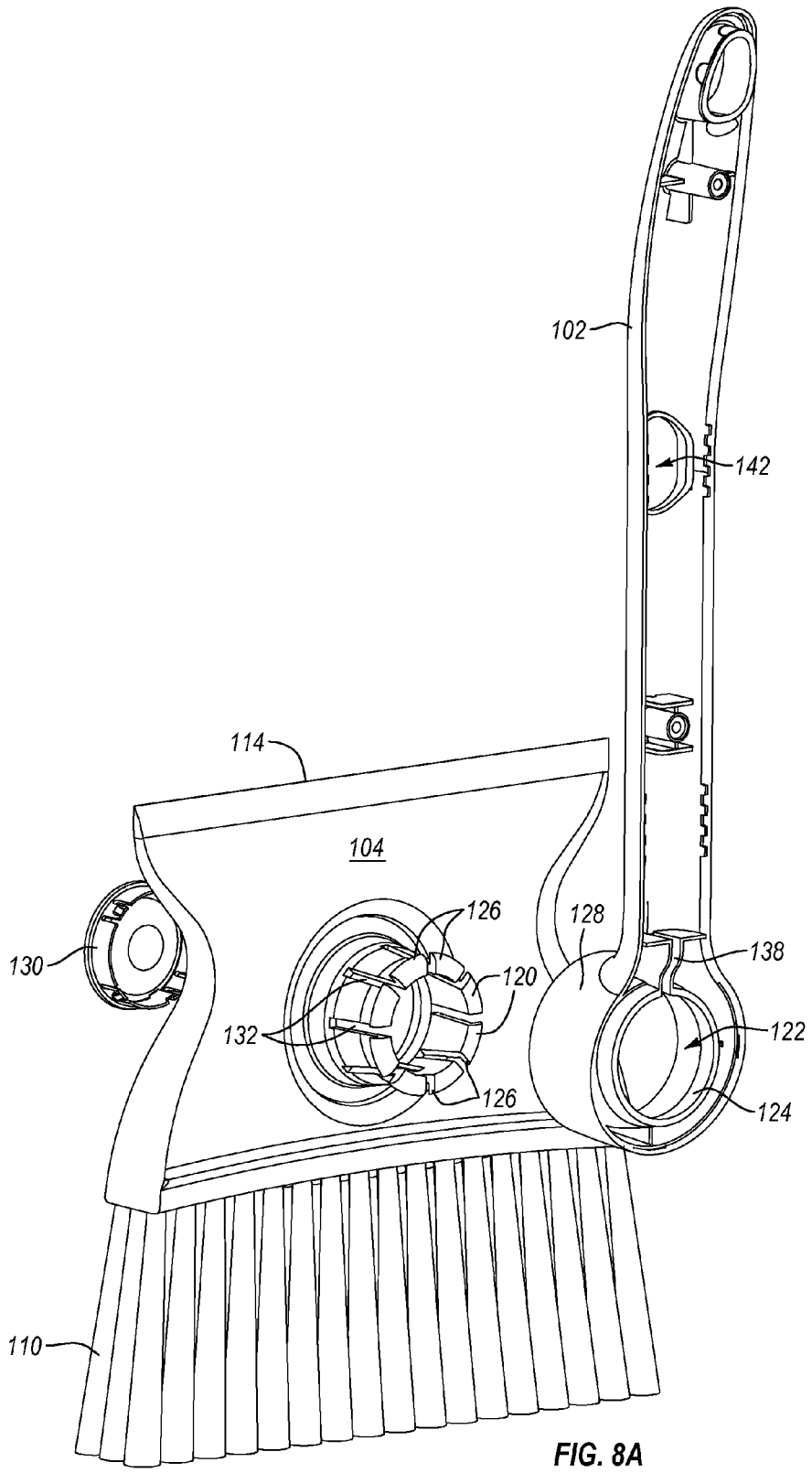
FIGS. 8A-8B show close up views of an exemplary snap-fit coupling that allows selective free rotation and selective locking of the combination broom and squeegee head into a desired orientation.
Figure 8B:
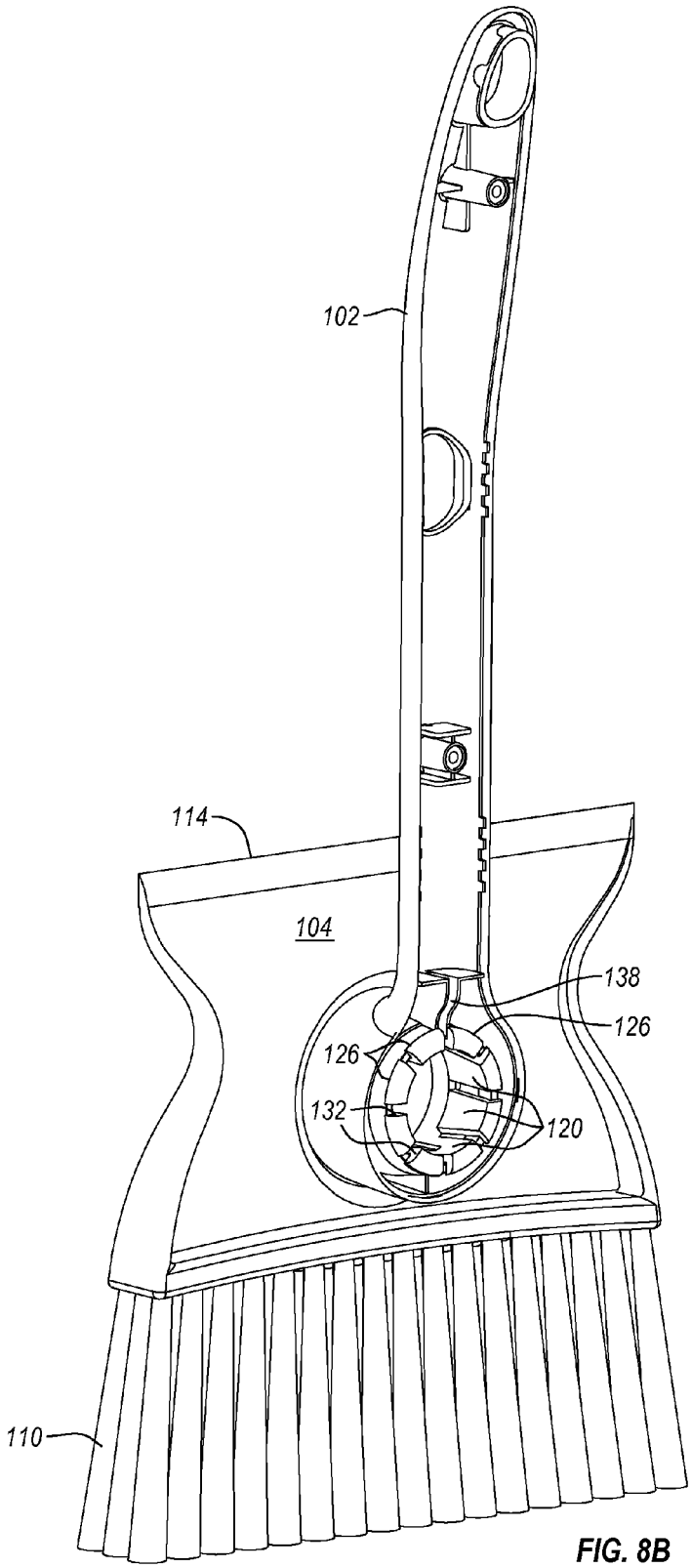
Figure 9:
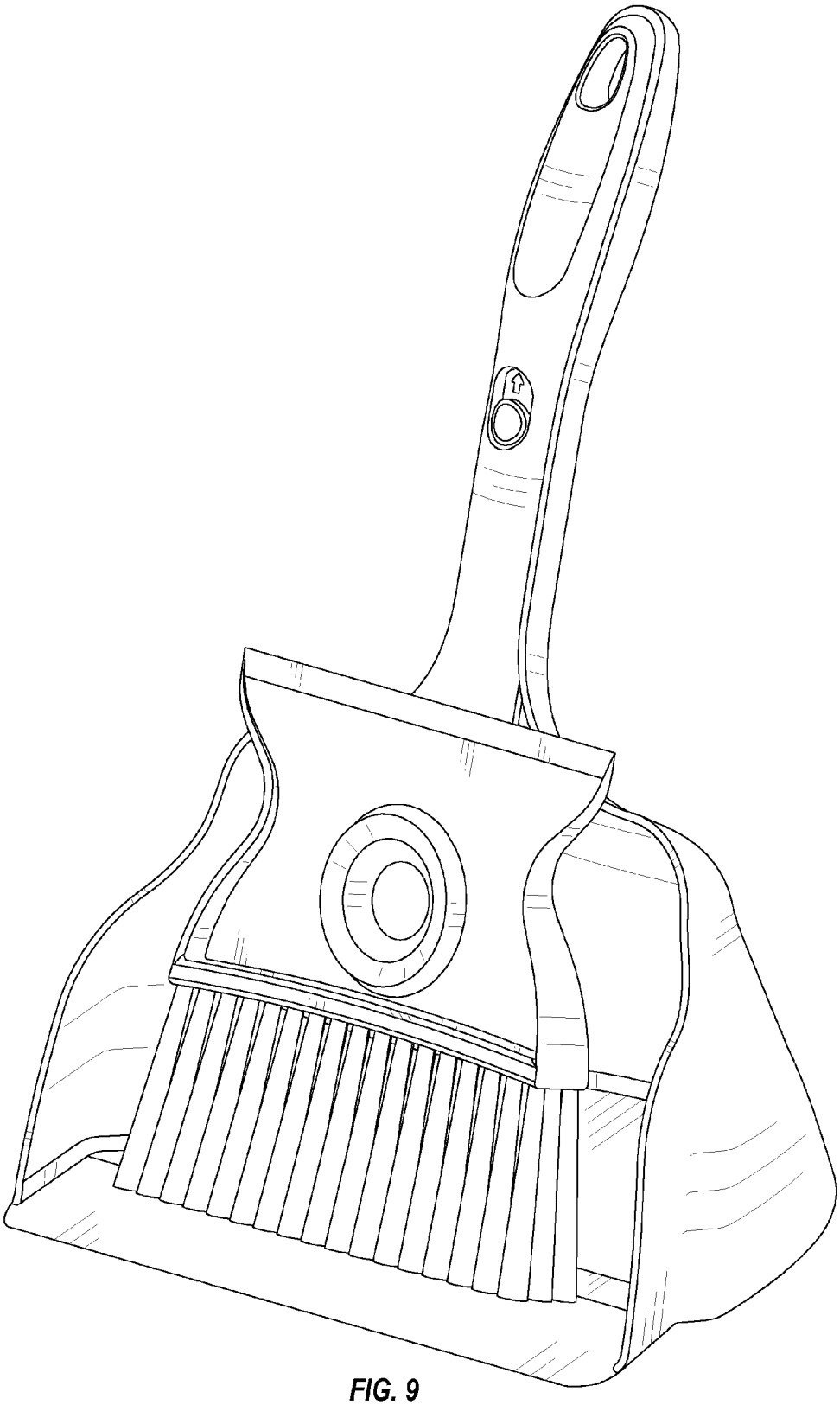
FIGS. 9-15 show a perspective view, a front view, a rear view, a side view, an opposing side view, a top view, and a bottom view, respectively, of an ornamental design of a combination whisk broom and squeegee according to the present invention.
Figure 10:
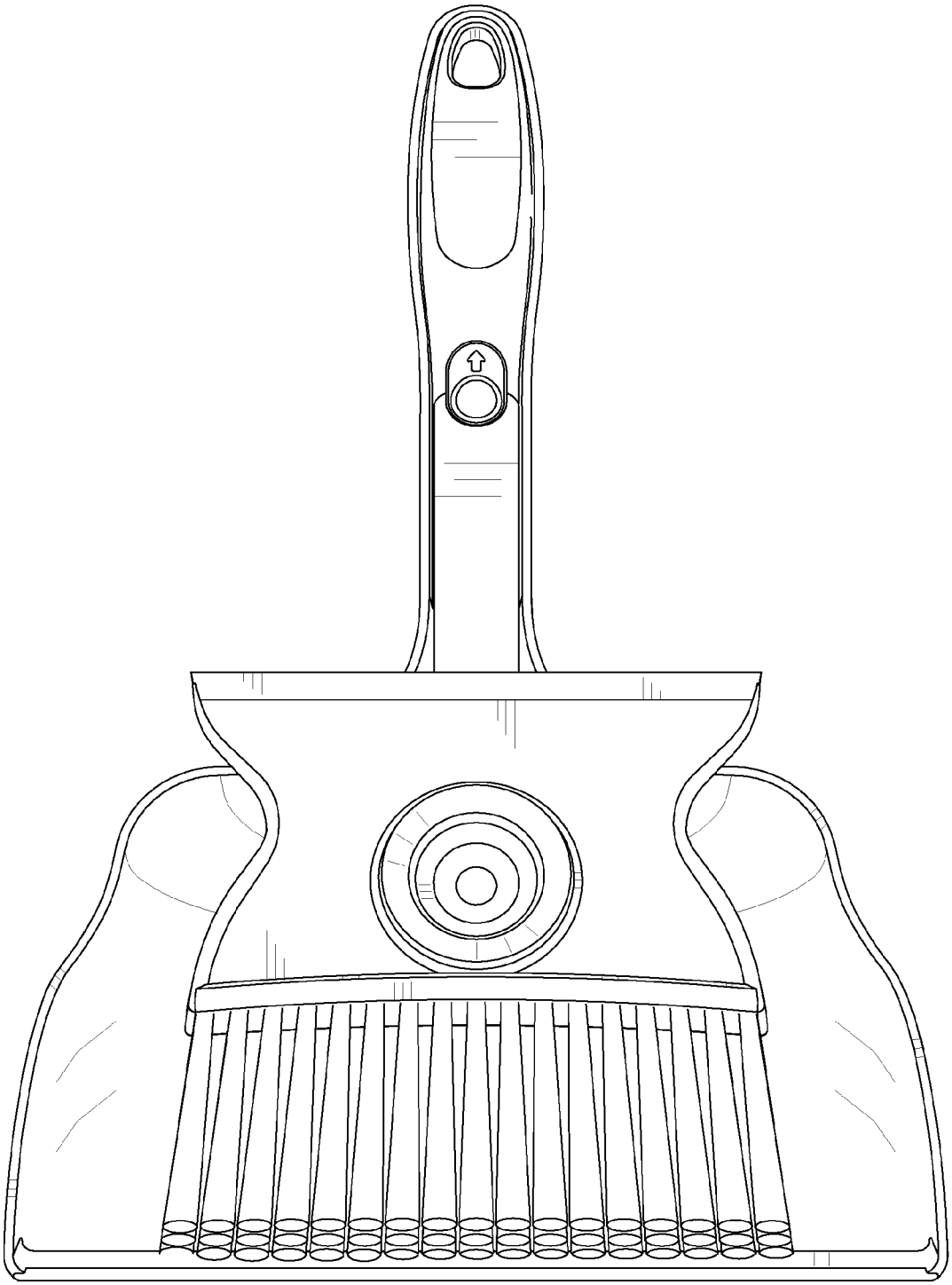
Figure 11:
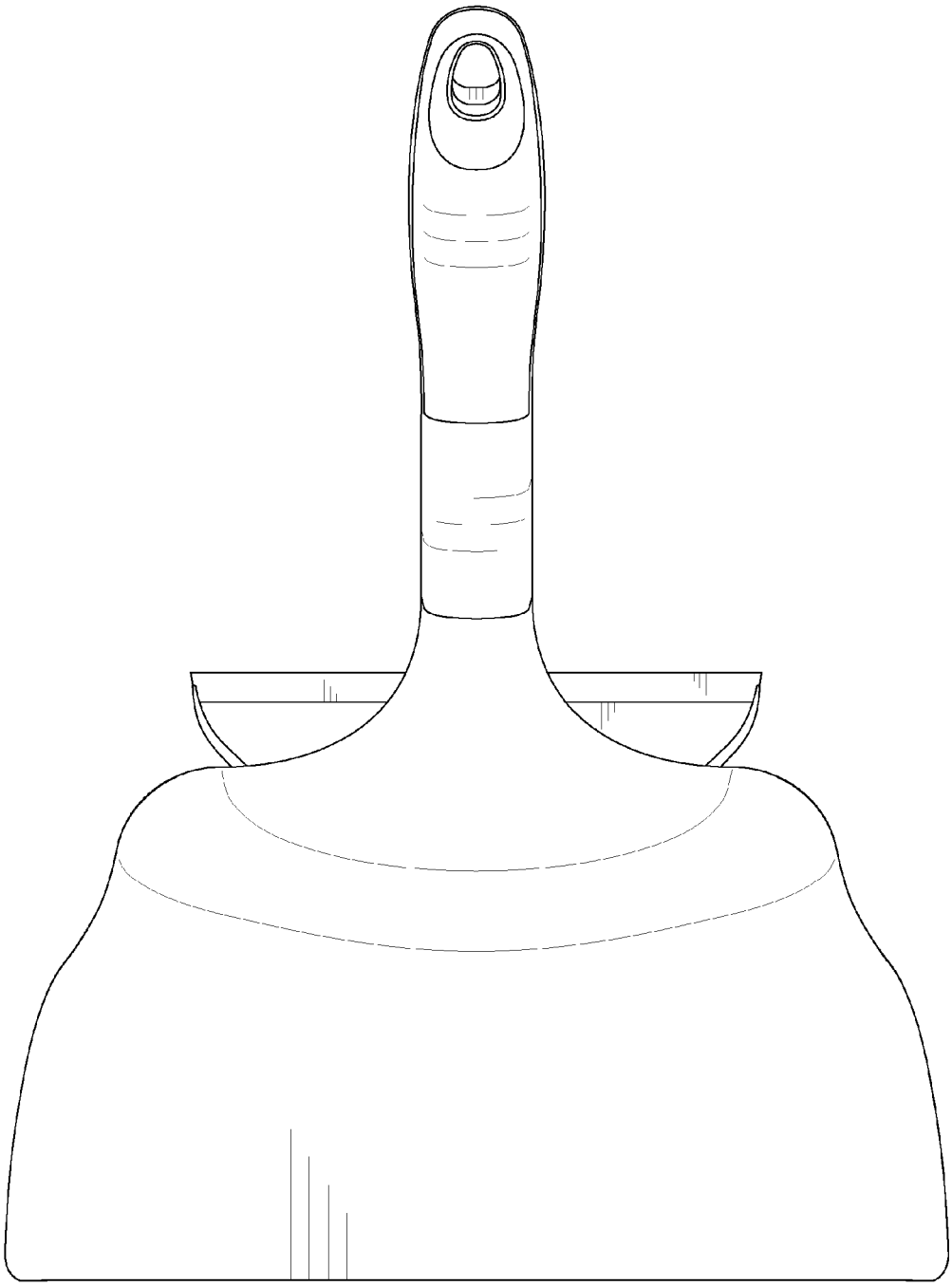
Figure 12:
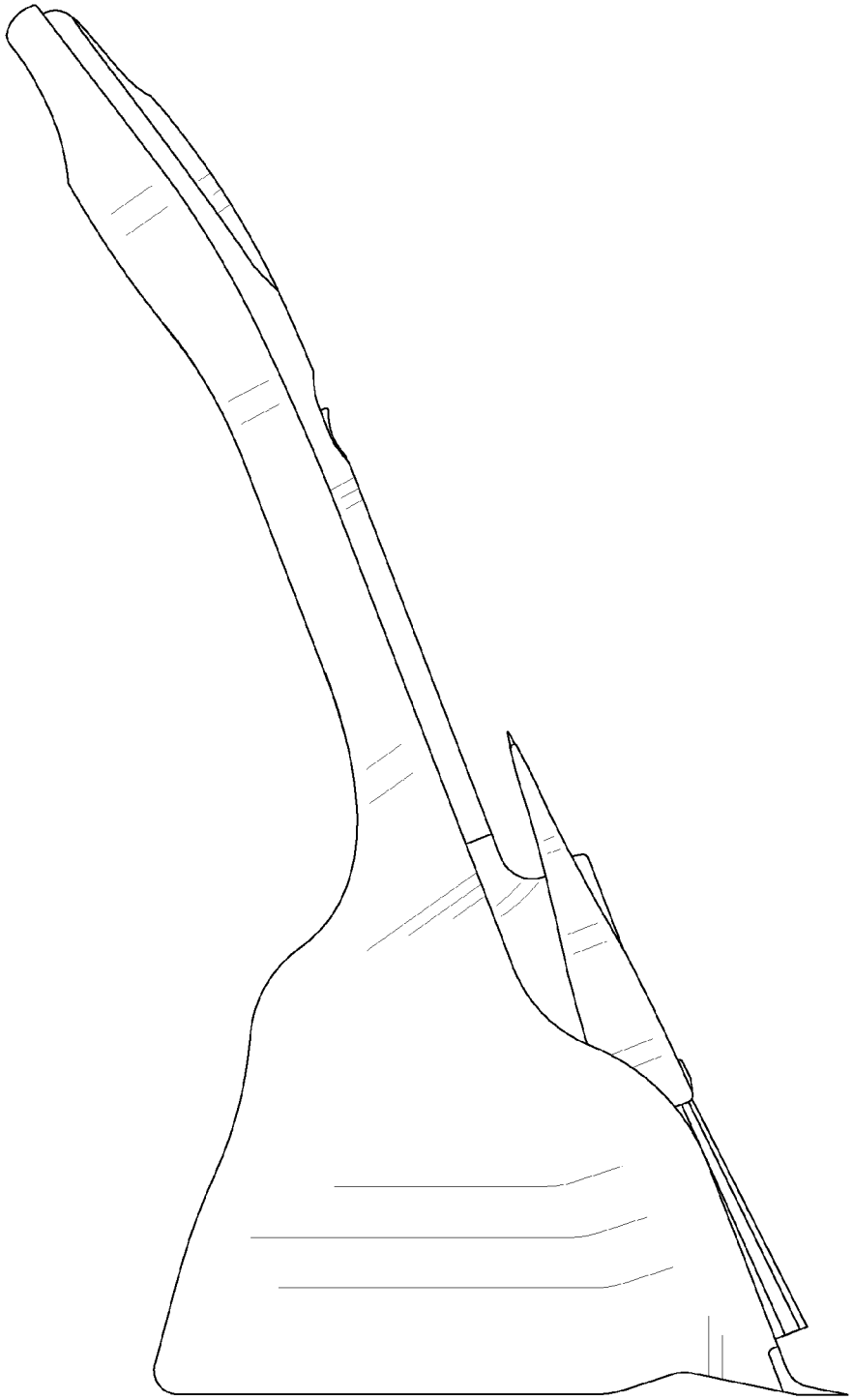
Figure 13:
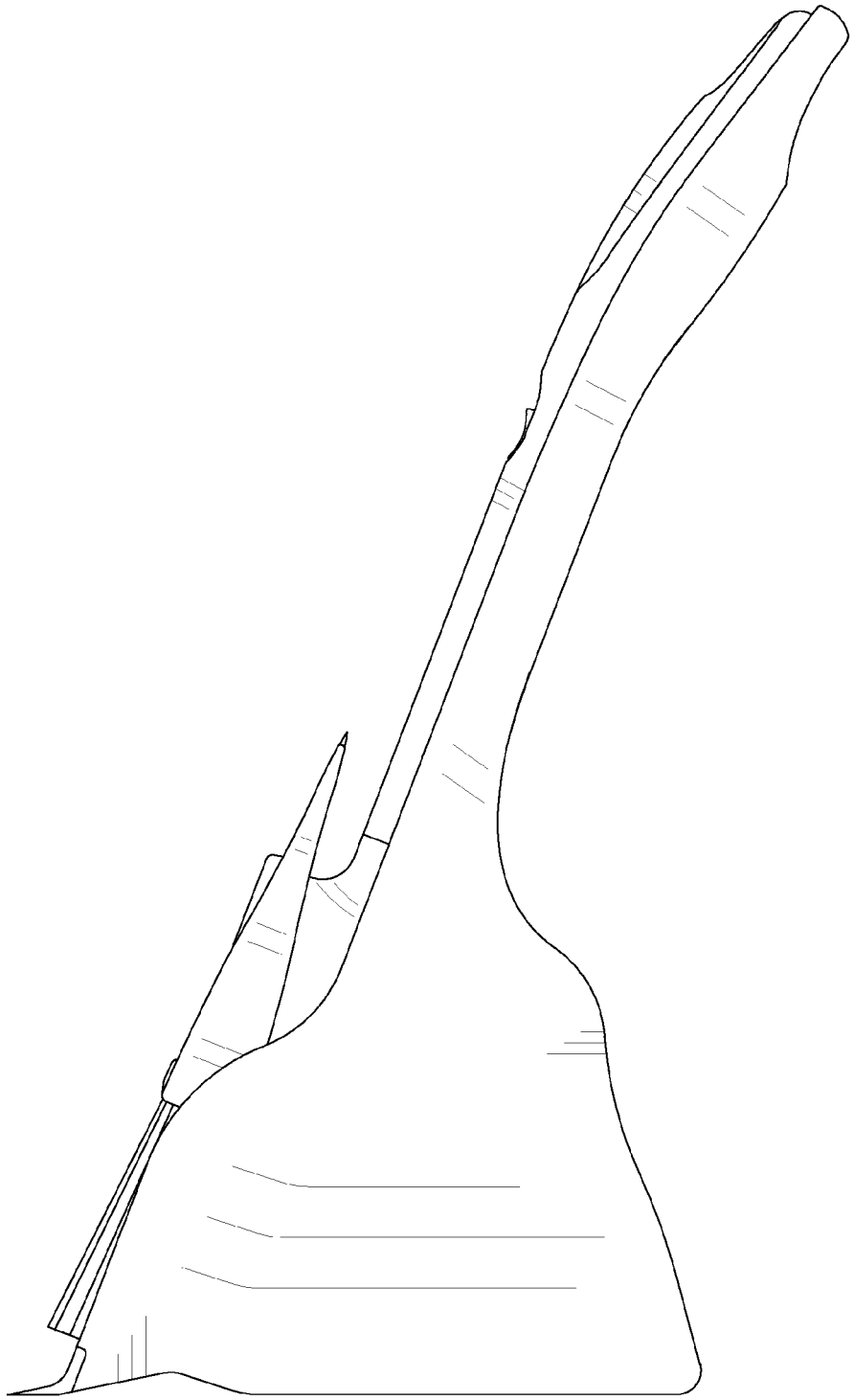
Figure 14:
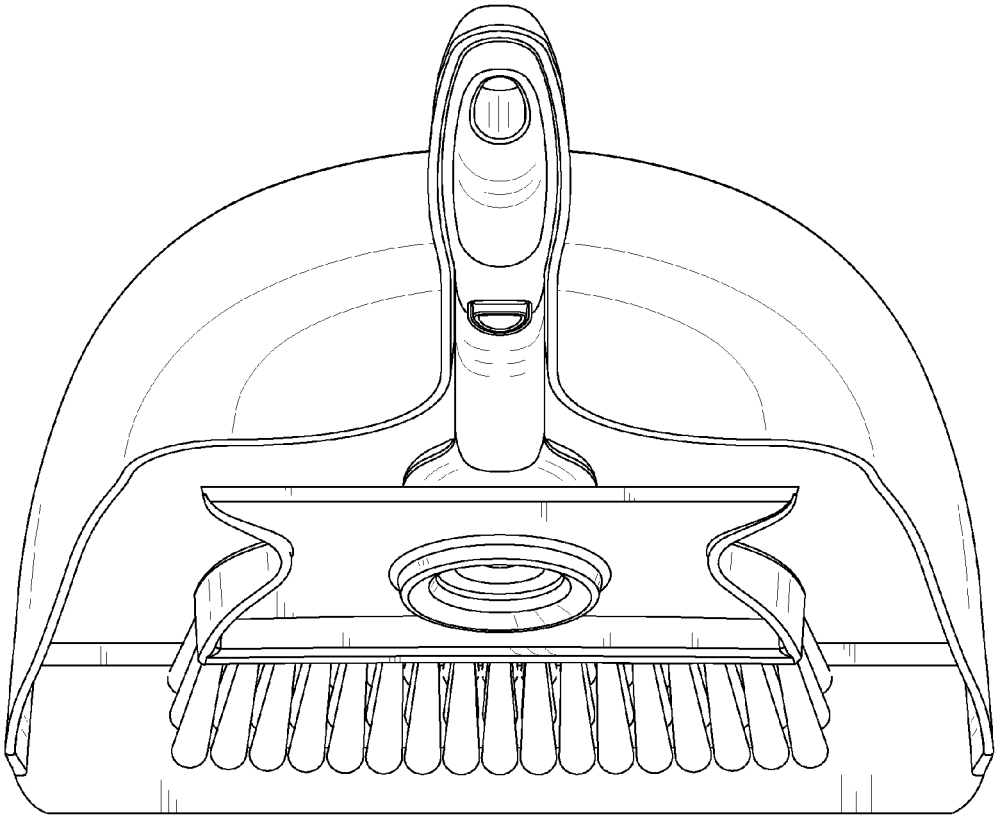
Figure 15:
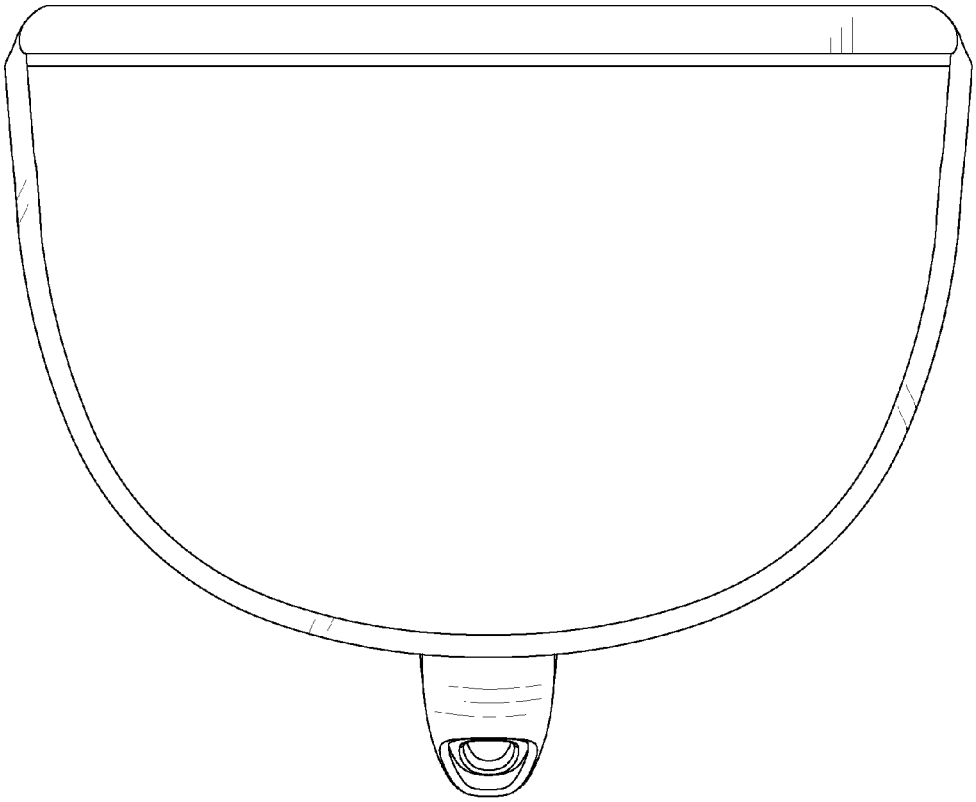

FIG. 7 shows an exploded view of device 100, illustrating coupling 116, as well as release button 106 and how they work together. FIGS. 8A and 8B show close up views of the coupling 116. For example, coupling 116 between head 104 and handle 102 may include a notched rearwardly extending cylinder 120 within head 104, which mates with a correspondingly shaped cylindrical recess 122 defined by cylindrical sidewall 124 of handle 102. Rearwardly extending cylinder 120 may have a length that is greater than the corresponding length of sidewall 124, so that when coupled with one another, as shown in FIG. 8B, the distal ends of notched cylinder 120 extend past the corresponding distal ends of sidewall 124. The extreme distal end of cylinder 120 may include an outwardly flared flange 126, as shown, allowing cylinder 120 to "snap" into place within cylindrical recess 122 upon coupling, as shown in FIG. 8B.

Because cylinder 120 is notched, it can easily flex inwardly (i.e., compress) as it is introduced into cylindrical recess 122. As soon as it is fully inserted, the outwardly flared flange ends 126 snap outwardly, so as to overhang the distal end of sidewall 124, coupling cylinder 120 and handle 102 together in a snap-lock connection. The coupling provides for free rotation of cylinder 120 within recess 122, and thus head 104 about handle 102.

As shown, handle 102 may terminate at its bottom end in an enlarged cylinder shape 128, which cylinder 128 may extend generally forwardly (opposed to the rearward extension of cylinder 120). Cylinder 128 is hollow, and includes sidewall 124 defining inner cylindrical recess 122 which mates with notched cylinder 120. As seen in FIG. 7, a covering cap 130 may be provided for fitting over (e.g., snap fitting) an open front end of the coupling structure of head 104. As is apparent in FIGS. 7-8B, the notches 132 of cylinder 120 may be spaced evenly (e.g., about every 45°, or about every 90°, etc.) about the circumference of cylinder 120. Notches 132 are shown extending fully to the distal end of cylinder 120, defining a plurality of tabs, so as to facilitate easy compression thereof as cylinder 120 is inserted into recess 122.

Referring again to FIG. 7, release button 106 may be coupled to coupling 116 by a sliding elongate locking pin 134 which extends longitudinally, down into handle 102. The distal end of sliding locking pin 134 includes a distal pin end 136, which is able to pass through channel 138 defined through sidewall 124, allowing distal pin end 136 to selectively engage with a given notch of notched cylinder 120 of head 104. Engagement of pin end 136 within any given notch 132 locks cylinder 120 against rotation. Upward sliding of locking pin 134 (and thus pin end 136) out of notch 132 (but still within guiding channel 138) frees head 104 so as to allow its rotation about handle 102. Sliding is achieved through use of release button 106, accessible on the front surface of handle 102. While locking pin 134 is not shown in FIGS. 8A-8B to more clearly show coupling 116, it will be understood that distal pin end 136 rides within channel 138, and into a single designated notch 132, as will be apparent from FIG. 7.

The handle 102 may include front and rear portions fastened together (e.g., snap fit and/or with fasteners such as screws, adhesive, etc.). Sliding locking pin 134 may be spring loaded (e.g., spring 140) within handle 102 so that button 106 is biased to a position corresponding to one where head 104 is locked against rotation relative to handle 102. Locking pin 134 may further include a spring retention protrusion 144 at its bottom end, adjacent the distal pin end 136, for retaining spring 140. Release button 106 may comprise a portion of sliding locking pin 134, which is manually accessible through a window 142 cut-out in the front portion of handle 102. The release button 106 and elongate sliding locking pin may be an injection molded single piece. Many of the other structures (e.g., forward and rear handle 102 halves, the head 104, the dustpan 150, etc.) may similarly be injection molded. As perhaps best seen in FIG. 1, the top portion of handle 102 may include an overmolded rubber or other elastomeric material 146 to increase tactile feel and grip for the user.

As used in this specification and the appended claims, the singular forms "a," "an" and "the" include plural referents unless the context clearly dictates otherwise.

The present invention can be embodied in other specific forms without departing from its spirit or essential characteristics. Thus, the described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A combination whisk broom and squeegee comprising:

an elongate handle; and a rotatable head rotatably attached to the handle, the head including a whisk broom end with a plurality of whisk broom bristles at one end of the head, the head further including a squeegee end at an end opposite the whisk broom end such that the whisk broom end may be used to sweep up dry spills and the squeegee end may be used to clean up wet spills;

wherein the head is rotatably coupled to the handle, the head being selectively rotatable and lockable in a desired orientation relative to the handle so as to orient the whisk broom end or the squeegee end in a desired locked orientation for use thereof; and a release button disposed on or within the handle and coupled to the coupling of the head to the handle for selectively releasing and selectively locking the rotatable head in a desired orientation relative to the handle;

wherein the coupling between the head and the handle comprises a notched rearwardly extending cylinder within the head that mates within a correspondingly shaped cylindrical recess disposed within the handle.

2. The combination whisk broom and squeegee as recited in claim 1, wherein the release button is configured to slide within the handle, a first position of the release button corresponding to the head being locked in a given orientation relative to the handle, while a second position of the release button corresponds to the head being freely rotatable about the coupling to the handle.

3. The combination whisk broom and squeegee as recited in claim 1, wherein the squeegee end comprises a rubber or elastomeric squeegee edge overmolded over the head.

4. The combination whisk broom and squeegee as recited in claim 3, wherein the plurality of whisk broom bristles are press-fit into the whisk broom end of the head.

5. The combination whisk broom and squeegee as recited in claim 1, wherein the coupling between the head and the handle comprises a configuration in which the notched rearwardly extending cylinder snap fits within the corresponding shaped cylindrical recess of the handle.

6. The combination whisk broom and squeegee as recited in claim 5, wherein the release button is coupled to the coupling by an elongate locking pin which extends down the handle, the distal end of the locking pin including a distal pin end which selectively engages within a given notch of the notched rearwardly extending cylinder of the head.

7. The combination whisk broom and squeegee as recited in claim 6, wherein the elongate locking pin further comprises a spring retention protrusion at its bottom end, adjacent the distal pin end.

8. The combination whisk broom and squeegee as recited in claim 1, wherein the handle terminates at its bottom end in an enlarged cylinder shape, the cylinder extending forwardly, towards the head, the cylinder shape of the handle being hollow and including a sidewall defining the cylindrical recess which mates with the corresponding notched cylinder of the head.

9. The combination whisk broom and squeegee as recited in claim 1, further comprising a cap that fits over an open front end of coupling structure of the head.

10. The combination whisk broom and squeegee as recited in claim 1, wherein the notches are disposed at least every 90° in the circumference of the rearwardly extending cylinder of the head.

11. The combination whisk broom and squeegee as recited in claim 1, wherein the notches are disposed at least every 45° in the circumference of the rearwardly extending cylinder of the head.

12. The combination whisk broom and squeegee as recited in claim 1, wherein the release button is coupled to the coupling by an elongate locking pin which extends down the handle, wherein the handle includes front and rear portions fastened together, wherein the locking pin is spring loaded within the handle so that the release button is biased to a position corresponding to one where the head is locked against rotation relative to the handle.

13. The combination whisk broom and squeegee as recited in claim 12, wherein a portion of the locking pin is manually accessible through a window cut-out in the front of the handle.

14. The combination whisk broom and squeegee as recited in claim 13, wherein the release button and the elongate locking pin comprise an injection molded single part.

15. The combination whisk broom and squeegee as recited in claim 1, wherein the release button comprises a finger recess which allows a user to easily pull the button upwards.

16. The combination whisk broom and squeegee as recited in claim 1, wherein a top portion of the handle further includes an overmolded rubber or other elastomeric material to increase tactile feel and grip for a user.

17. The combination whisk broom and squeegee as recited in claim 1, further comprising a dustpan including a dustpan handle, the dustpan handle being hollow and correspondingly shaped and sized to receive the handle of the combination whisk broom and squeegee therein when the broom handle is pressed into the dustpan handle.

18. The combination whisk broom and squeegee as recited in claim 17, wherein the dustpan further comprises an integrated retention dam in a bottom interior surface thereof to help retain debris placed inside the dustpan.

19. The combination whisk broom and squeegee as recited in claim 17, wherein a leading edge of the dustpan further comprises an overmolded or other elastomeric material edge to help seal the dustpan to the floor during use.

20. The combination whisk broom and squeegee as recited in claim 17, wherein the dustpan handle and the handle of the combination whisk broom and squeegee each further comprise aligned eyelet hanging holes for hanging the combination whisk broom and squeegee when coupled with the dustpan on a hook.

* * * * *